United States Patent [19]

Stefnik et al.

[11] Patent Number: 4,680,902

[45] Date of Patent: Jul. 21, 1987

[54] UNITIZED PARTITION SYSTEM

[76] Inventors: William S. Stefnik, 955 Lake Christina Way SE., Calgary, Alberta, T2J 2R2; Frank J. Grims, 28 Deerwood Road SE., Calgary, Alberta, T2J 6E1, all of Canada

[21] Appl. No.: 766,430

[22] Filed: Aug. 16, 1985

[30] Foreign Application Priority Data

Aug. 24, 1984 [CA] Canada ..... 461795

[51] Int. Cl.[4] ..... E04G 21/14; E04B 2/82

[52] U.S. Cl. ..... 52/126.4; 52/242; 52/586; 52/806

[58] Field of Search ..... 52/238.1, 126.4, 471, 52/806, 821, 586, 242

[56] References Cited

U.S. PATENT DOCUMENTS

| | | | |
|---|---|---|---|
| 3,063,522 | 11/1962 | Graff | 52/586 X |
| 3,075,253 | 1/1963 | Hammitt et al. | 52/586 X |
| 3,217,452 | 11/1965 | Steele | 52/586 X |
| 3,566,559 | 3/1971 | Dickson | 52/126.4 |
| 3,641,730 | 2/1972 | Meckstroth | 52/586 |
| 3,699,734 | 10/1972 | Craig | 52/586 |
| 3,778,954 | 12/1973 | Meserole | 52/586 |
| 3,885,361 | 5/1975 | De Schutter | 52/126.4 |
| 4,103,463 | 8/1978 | Dixon | 52/126.4 |

FOREIGN PATENT DOCUMENTS

| | | | |
|---|---|---|---|
| 2758824 | 7/1979 | Fed. Rep. of Germany | 52/586 |
| 2388122 | 12/1978 | France | 52/586 |

*Primary Examiner*—Alfred C. Perham

*Attorney, Agent, or Firm*—Berman, Aisenberg & Platt

[57] ABSTRACT

There is provided a new and useful system for the construction of partition walls comprising: a floor channel adapted to be secured to a building floor; a ceiling channel adapted to be connected to a building ceiling; a series of rectangular panel assemblies each including a rectangular frame having top, bottom and side edges, a pair of rectangular panels secured to opposite sides of the frame, and a pair of adjustable support members associated with the bottom side of the frame; and wherein the side edges of the frame extend beyond the top and bottom edges thereof and include longitudinal recessed channels; and, an elongated spline including first and second lateral extensions adapted to connect two adjacent panel assemblies and to extend into the ceiling channel, the spline adapted to be moved laterally from a first position wherein the spline is contained entirely within the said recessed channel of one panel assembly to a second position wherein the first and second lateral extensions extend respectively into the adjacent recessed channels of the pair of adjacent panel assemblies.

5 Claims, 16 Drawing Figures

UNITIZED PARTITION SYSTEM

This application relates to unitized panel assemblies for partition walls and to non-progressive partition systems using the panel assemblies.

BACKGROUND OF THE INVENTION

Various types of partition systems have been developed over the years in an attempt to meet the needs of modern highrise office towers. Conventional drywall partitions initially offered advantages when compared with the older plaster walls. Conventional drywall construction, however, is totally inadequate for modern requirements.

Conventional drywall construction is labour intensive and, accordingly, the cost factor alone prohibits its use in large projects.

Equally significant in the highrise office tower situation is the need to have partition walls which can be disassembled and reassembled in different configurations to meet changing office requirements. It has been found that an average of ten to fifteen per cent of the partitions in a highrise (office) tower are moved each year.

Various systems have been developed in an attempt to meet cost and moveability criteria. To date, however, each such proposed system has suffered from a number of deficiencies. Furthermore, developing construction methods are continuously dictating additional requirements, so that older systems become progressively less satisfactory.

For example, it was formerly the case that partition walls were required to follow the grid system utilized in a modern suspended ceiling, so that the partition wall would be directly below the suspended T-bars of the ceiling. By contrast it is now highly desirable that alignment as between the T-bars and the partition walls be avoided. This arrangement allows the integrity of the T-bars to be maintained and not be broken, for example, by wiring or the like leading from the wall into the ceiling. This requirement has very important implications for the dimensions of modular systems, particularly at module joints and at partition wall corners.

In addition, aesthetic requirements have become increasingly more demanding. It can generally be said that the closer a partition system approaches conventional drywall partitions in appearance, the more acceptable it will be. The appearance is generally enhanced by partition systems not readily displaying joints and the like in a straight run of wall and by improved finishing components.

Finally, while the moveability criteria has received attention in the design of present systems, those systems have been primarily directed toward the initial construction situation and are primarily governed by first cost considerations. As a secondary aspect, the moveability problem has received less attention, and this has led to difficulties. For example, present partition walls have generally affected cosmetics to the extent that ceilings, floors, and the like are often damaged by the walls and require repair or partial replacement when walls are moved. This adds to the time and expense of the moving process, and, in view of the significant amount of this activity required, as noted above, in a highrise office tower, the wall relocation cost factor is of major proportions.

Most modern so-called moveable systems still require very extensive labour input at the building site. In most cases this includes some assembly of the panel assemblies themselves. The cost savings to be provided by a unitized system in which the panel assemblies can be completely factory constructed cannot be overemphasized. The economics are even more attractive as one moves away from more expensive materials such as steel to utilize less expensive and more attractive building materials.

It is against this background that the present invention arises. The panel assemblies and partition systems of the present invention have been specifically designed to take into account problem areas in both first cost installations and in refits, and emphasizing both aspects. Thus, while cost advantageous at the construction stage, the new assemblies provide very significant advantages in the subsequent inevitable wall rearrangements.

PRIOR ART

Applicant is unaware of any prior art which is of particular relevance to the present invention. Some secondary features of the invention are similar to corresponding features of applicant's copending application, Ser. No. 766,431, filed on Aug. 8, 1985.

SUMMARY OF THE INVENTION

The present invention combines a low initial cost non-progressive unitized partition system with a high level of versatility not normally found in such a system.

Thus the invention provides a system for the construction of partition walls comprising:

(a) a floor channel adapted to be secured to a building floor;

(b) a ceiling channel adapted to be connected to a building ceiling;

(c) a series of rectangular panel assemblies each including a rectangular frame having top, bottom and side edges, rectangular panels secured to opposite sides of the frame, and at least one adjustable support member associated with the bottom side of the frame, and wherein the side edges of the frame extend beyond the top and bottom edges thereof and include longitudinal recessed channels; and, (d) an elongated spline including first and second lateral extensions adapted to connect two adjacent panel assemblies and to extend into the ceiling channel, the spline adapted to be moved laterally from a first position wherein the spline is contained entirely within the said recessed channel of one panel assembly to a second position wherein the first and second lateral extensions extend respectively into the adjacent recessed channel of the pair of adjacent panel assemblies.

GENERAL DESCRIPTION

The system of the invention is designed to have a low first cost, and this is achieved by simplifying the system to as great an extent as possible. At the same time the versatility required to maintain low refit cost has been retained in the system.

The key to the system is the combination of specially designed frames on the panel assemblies with splines for joining the assemblies. The frames are preferably metal extrusions or rolled steel. They provide flat facings to which are attached a pair of panels, preferably by gluing. At least the two long sides of the frame, which in use are the vertical sides, include longitudinal channels recessed into the frame.

The splines include lateral extensions and the extensions mate with the channels of the adjacent panel assemblies to join the assemblies.

In order to facilitate the removal and/or insertion of individual panel assemblies, doors, glazed panels and the like, and to allow for rearrangement of walls, corners, and so on, each spline is constructed to be capable of being entirely recessed in the recessed channel of either of the adjacent panel assemblies. The splines are capable of being moved laterally from a position where the lateral extensions on the splines engage the channels of two adjacent panel assemblies to a position where the lateral extensions are completely contained within the channel of one of the panel assemblies. Since the splines extend into the system's ceiling channels to maintain the panel assemblies in position, this lateral movement of its associated splines out of engagement with the channels of a panel assembly allows that assembly to be removed from a wall without disturbing adjacent assemblies.

Access to the splines when in the assembled position is readily available since the panel assemblies are preferably of less overall height than the distance between the system's floor and ceiling channels and are maintained between these channels by adjustable foot supports. The splines extend at the bottom to a point below the bottom of the assembly and at the top up into the ceiling channel. The splines can thus be manipulated by contact in the space between the top and bottom of the panel assembly and the floor and ceiling channels respectively.

In the preferred case the frame edge channels are extended above the top and bottom of the panel assembly to provide a surface to which access is readily available and through which the splines can be secured in the assembled position, as by screws.

Additional features of the invention are described in detail below.

BRIEF DESCRIPTION OF THE DRAWINGS

In drawings which illustrate embodiments of the invention.

Figure 1:
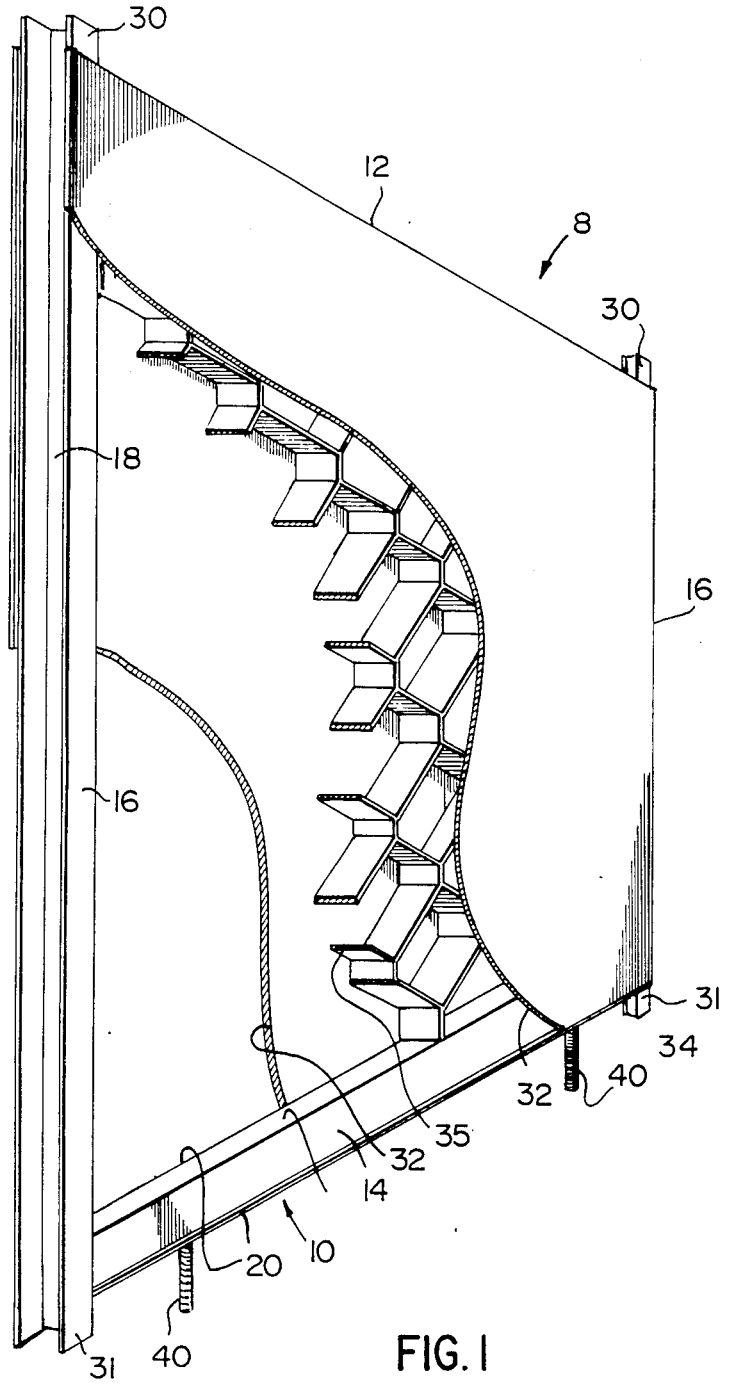
FIG. 1 is a perspective view, partly cut away, of a panel assembly according to the invention.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The basic panel assembly 8 of the invention comprises a frame 10 comprising top member 12, bottom member 14 and two side members 16 (only one of members 16 illustrated in each drawing). The top member 12 and two side members 16, as illustrated, are basically channels providing a channel or recess 18 into the edges of the panel assembly.

The bottom member 14 is preferably modified somewhat (see FIG. 3) to provide a pair of external flanges 20 and the internal web 24 and flanges 26.

The side members 16 are extended at 30 and 31 a short distance (typically 2.5 cm (1 inch)) above the top and bottom members 12 and 14 respectively.

While a specific configuration and cross section of the frame have been illustrated, any other suitable configuration could be substituted. Of importance is the requirement that a recess or channel be provided in the sides 16 of the frame to cooperate as will be described with the splines 96.

Panels 32 are secured to the frame 10 preferably by gluing. The bottom edges 34 of the panels are partially supported and protected by the flanges 20 on the bottom frame member 14. Any type building panel may be utilized, but generally a gypsum board type is desired and preferred. The exposed surface of the panels may be finished as required, preferably before construction of the assembly.

It is of substantial labour-saving benefit that there are, following assembly, no exposed parts of the panel assemblies to be finished. The finish can thus be applied to the individual panels 32 at the factory prior to construction of the panel assemblies 8. No filling, sanding or the like is required after the panel assemblies 8 are put together.

Stiffening or insulating material may be inserted between panels 32. For example, a paperboard honeycomb stiffener 35 is illustrated in FIG. 1.

Figure 2:
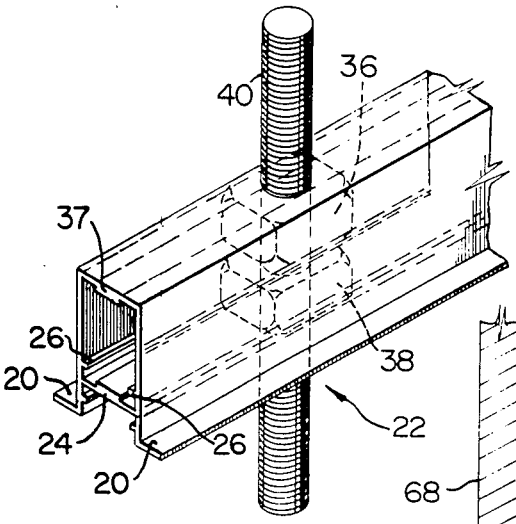
FIG. 2 illustrates a levelling device for use with the panel assemblies of the invention.

In the preferred case, prior to fabrication of the panel assembly, a pair of levelling devices 22 are placed in the bottom frame member 14, as illustrated in FIG. 2. Vertically aligned pairs of holes are drilled through the webs 24 and 37. The nuts 36 and 38 are then slid into the interior of the member 14 with nut 36 adjacent web 37 and nut 38 adjacent flanges 26. The threaded support member 40 is then inserted through one of the pair of holes, rotated in threaded engagement through nuts 36 and 38 and finally through the second of the pair of holes.

When the panel assembly 8 is placed in position, as will be discussed below, the assembly rests on the supports 40. Height and levelling adjustments are effected by rotating the members 40. The rotation can conveniently be carried out simply by grasping the support 40 with pliers or the like.

When assembled into a partition system, each panel assembly remains an independent unit which can be removed, reinserted, or the like without interference with adjoining panel assemblies. All adjustments, positioning, and securing of the assemblies are independent of the positioning of adjoining assemblies.

Figure 3:
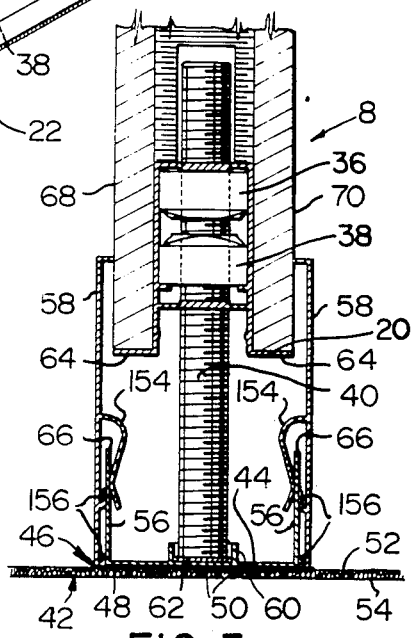
FIG. 3 illustrates the floor connection of the panel assemblies of the invention.

FIG. 3 illustrates the preferred manner of securing the panel assemblies 8 to the floor 42 in a partition system. A floor channel 44, preferably of extruded aluminum, is laid along the floor 42. The channel 44 preferably rests on a "carpet grabber" 46 comprising a platform 48 resting on a series of protrusions 50. The protrusions 50 penetrate the carpet 52 and rest on the unfinished floor 54 below carpet 52. The channel 44 is secured against lateral displacement by attachment to the platform 48 by two-sided tape, adhesive, or the like. The protrusions 50 are preferably punched and bent from the platform 48 of the "grabber" 46. The protrusions 50 serve the dual function of establishing and maintaining the lateral position of channel 44 and of preventing crushing of the carpet 52. The latter function is of significant importance in enhancing moveability of the partitions, since it ensures that substantially no trace of a wall will remain on the floor carpet when the channel is removed.

The channel 44 preferably includes the upstanding outer parts 56 which serve as support members for finishing strips 58.

A subchannel 60 runs longitudinally down the channel 44 and serves as a lateral positioning channel for the supports 40. There are preferably within the subchannel 60 pads 62 which are slideable therein and upon which supports 40 rest.

The levelling support 40 will always be adjusted such that the bottom edge 64 of panel assembly 8 is above the level of the top edges 66 of channel parts 56.

This last factor contributes to the expected lifetime of the assembly 8 since it means that the channel sides 56 and the exposed surfaces of the panels 68 and 70 will not be in rubbing or other contact with each other in construction of a wall or in subsequent use. This removes the problem, insofar as the bottom of the panel is concerned of marred finish normally associated with construction and demounting of partition walls.

It is notable that this advantage can only be gained where the finishing or trim strips 58 are separate from the channel sides 56.

Figure 4:
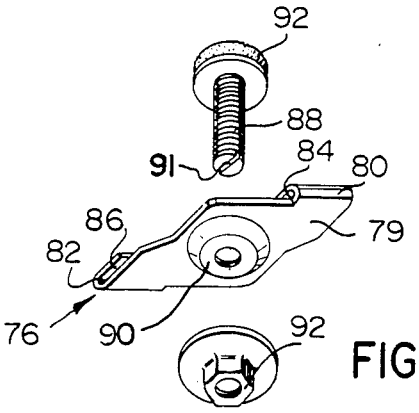
FIG. 4 illustrates a clip used in the ceiling connection of the panel assemblies of the invention.
Figure 5:
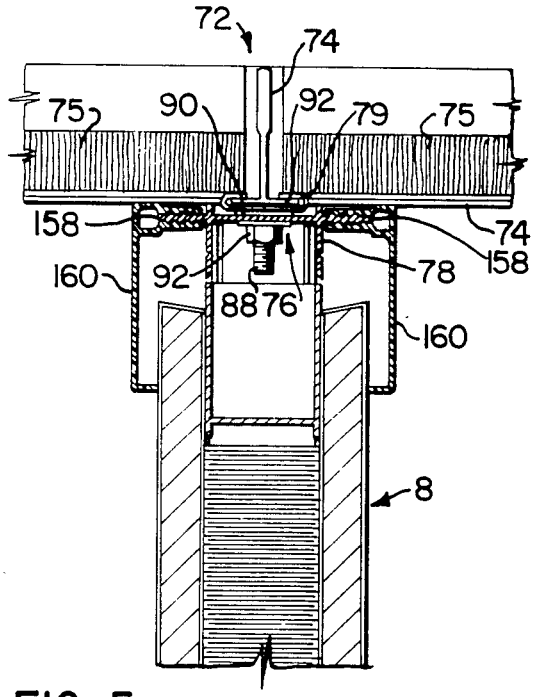
FIG. 5 illustrates the ceiling connection for the panel assemblies of the invention.

FIGS. 4 and 5 illustrate the preferred manner of securing the panel assemblies 8 to the ceiling 72 in a partition system. Since the system of this invention is specifically designed for use with the suspended ceilings of modern commercial buildings, the ceiling 72 as illustrated consists of a suspended grid of T-bars 74 in combination with ceiling tiles 75.

For purposes of securing in position the top of a panel assembly 8, a ceiling channel 78 is secured to T-bar 74 by means of a series of clips 76. The clips 76 comprise a flat plate section 79 having a pair of projections 80 and 82 integral therewith and bent over to form a pair of parallel short channels 84 and 86. The said projections and channels are located diagonally from each other across plate 79. The channels 84 and 86 are spaced from each other such that when the clip is placed adjacent a T-bar and rotated, the channels receive the edges of the T-bar.

The clip 76 is maintained in position on the T-bar 74 by the bolt 88 acting in a threaded depression 90 in plate 79. A non-marking pad 92, preferably of felt, is secured to the top of bolt 88, as by gluing. The pad 92 projects above the surface of the plate 79 and is the only contact of the clip 76 with the exposed surface of the T-bar 74.

In the preferred case the bolt 88 is provided with a slot 91 or similar means by which the bolt can be tightened to engage the padded top of the bolt 88 against the T-bar 74 and to thereby draw the sides of the channels 84 and 86 downward against the upper side of the T-bar.

The bolt 88 projects through a hole provided for the purpose in the ceiling channel 78 and the said channel is secured to the bolt 88 by the nut 92. As the nut 92 is tightened, the channel 78 abuts the depression 90 in the plate 79 and thereby secures the channel 78 to the clip 76 and also tends to restrain the plate 79 against rotation.

In the preferred case an insulating and padding strip 94 (not illustrated) is interposed between the channel 78 and the T-bar 74. The strip in the area of clips 79 is located between the channel 78 and the plate 79.

There remains to be described the manner of attaching the panel assemblies 8 to the ceiling channel 78 and to adjoining panel assemblies.

Figure 6:
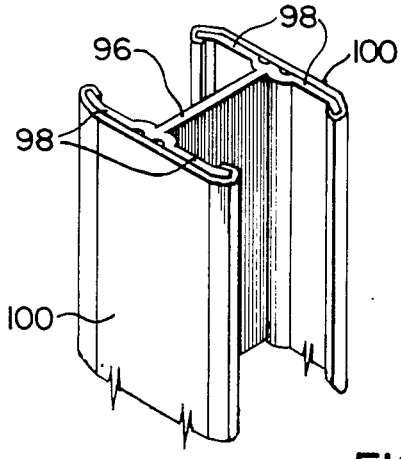
FIG. 6 illustrates a spline for use in joining panel assemblies according to the invention.
Figure 7:
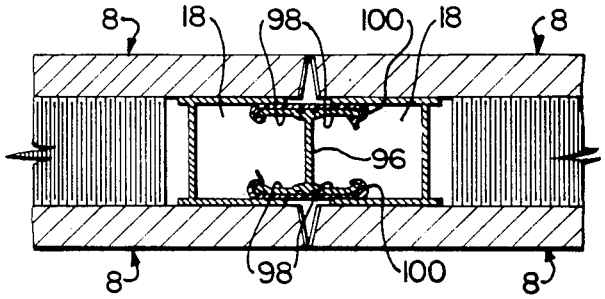
FIG. 7 is a vertical section through part of two panel assemblies according to the invention joined at 180 degrees.
Figure 8:
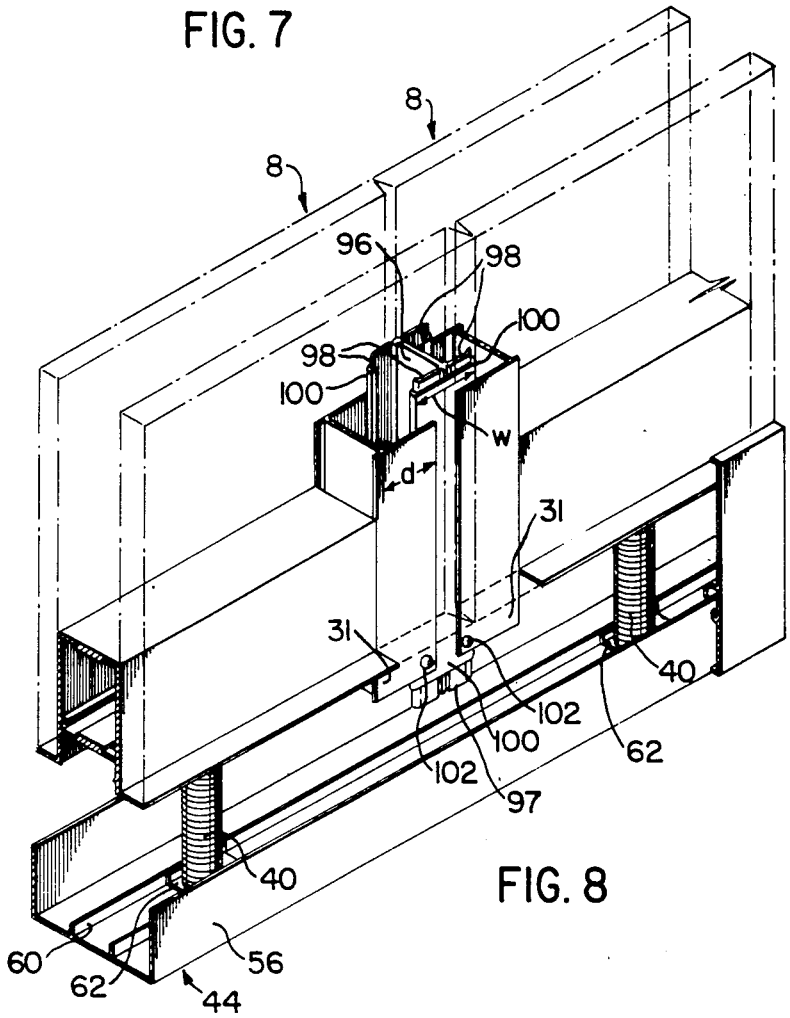
FIG. 8 is a perspective view of the floor condition of a pair of panel assemblies joined according to the invention.
Figure 9:
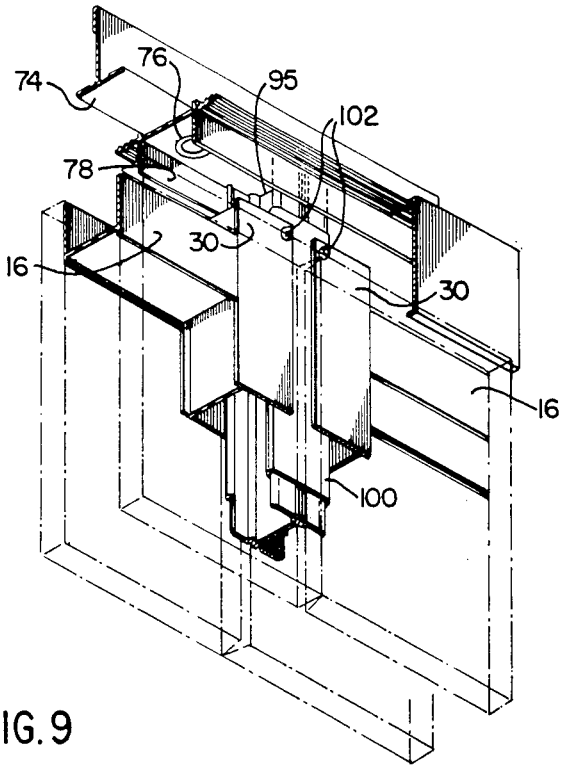
FIG. 9 is perspective view of the ceiling condition of a pair of panel assemblies joined according to the invention.

As illustrated in FIGS. 6, 7 and 8, a spline 96 is provided to mate with the channels 18 on the edges of adjoining assemblies 8. When positioned in a partition, the spline 96 is centrally located between a pair of assemblies 8. The arms 98 of the spline 96 extend into respective ones of the adjacent channels. In the preferred case, plastic overlays 100 on the arms 98 provide a degree of frictional engagement with channels 18 and at the same time facilitate sliding of the spline in the channels.

The spline 96 extends at the bottom 97 below the end of channel extension 31 and at the top 95 up into the ceiling channel 78. The spline 96 is preferably secured in position by means of screws 102 inserted through the channel extensions 30 and 31 and through arms 98 of spline 96. Self-tapping screws have been found most effective for this purpose.

The configuration of the spline 96 may be varied as required. The simple "H" shape illustrated has been found to be inexpensive and suitable for the purpose.

As will be discussed, it is required that the width "w" of the spline 96, including the arms 98, be less than the depth "d" of the channel 18.

Still in terms of a single panel assembly, the basic method of erecting a panel is to position a pair of slideable pads 62 in the subchannel 60 of floor channel 44. It should be noted that pads 62 are generally advantageous but not essential. The assembly 8 is then positioned in the floor channel 44 with the supports 40 resting on pads 62. The assembly 8 is then moved to the vertical position with the top of the assembly aligned with ceiling channel 78.

The panel assembly 8 can then be positioned longitudinally in the floor channel 44 by sliding it along on pads 62 in the subchannel 60. Further adjustment can be made by means of supports 40.

Finally, in the case of a single panel standing alone, a pair of splines 96 would then be inserted into the channels 18 extending into the ceiling channel 78.

In the more usual case, a panel assembly 8 will abut at 180 degrees the edge of an already erected adjacent panel in a partition run, or will abut a wall or form one side of a corner at 90 degrees. In each of these cases one edge of the assembly will mate with a spline 96, a special end channel such as that illustrated at 106 in FIG. 10, or the like member which is already in place. In such a case only the opposite edge of the new assembly 8 will require to have a spline 96 inserted. The spline is then preferably secured in place as illustrated by screws 102.

When a second panel assembly 8 is joined to a first one and mated with a spline secured in a first said assembly, the channel extensions 30 and 31 of the adjacent assemblies 8 are preferably drawn tightly together using a clamping tool and held such until all screws 102 are in place.

If desired, although generally not necessary, a permanent clamp or nut and bolt connection can be made between the channel extensions 30 and 31 of adjacent panel assemblies. Such a connection would simply reinforce the function of screws 102.

It is a very significant aspect of the relationship between the panel assemblies and the channels that the height of the panel assemblies is less than the distance between the floor and ceiling channels and that the supports 66 maintain the bottom of the panel assembly above the top of the floor channel. The panel assembly is thus suspended between the two channels with contact only through supports 40 and splines 96. There is therefore eliminated the problem of scraping or tearing of the panel skin during insertion or removal to or from the system. This factor adds substantially to the life expectancy of the panels.

The real advantage of the spline and channel connection arises in the refit situation where individual panels are to be removed to rearrange walls, insert doors and the like operations. By removing the screws 102, and because the ends of the spline 96 are exposed above and below channel extensions 30 and 31 respectively, the spline 96 can be urged to right or left until it is located entirely within one of the adjacent pair of channels 18 in the edge of the panel assemblies 8. At this point one end of a panel to be removed is free from restraint.

When this procedure is repeated at the opposite end of the panel to be removed, the panel is totally free from restraint and can be removed from its position without disturbing adjacent assemblies.

Figure 10:
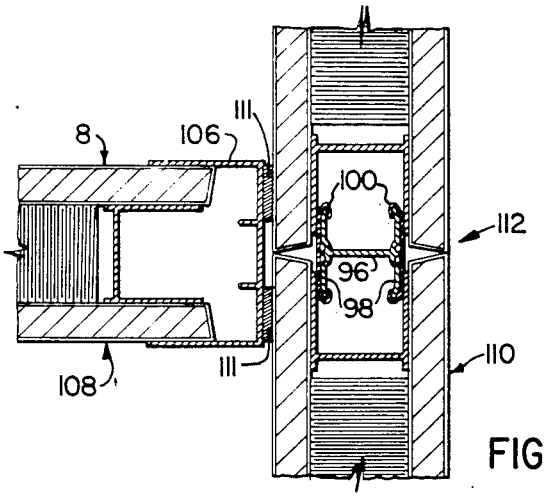
FIG. 10 is a vertical section through a T-intersection according to the invention.
Figure 11:
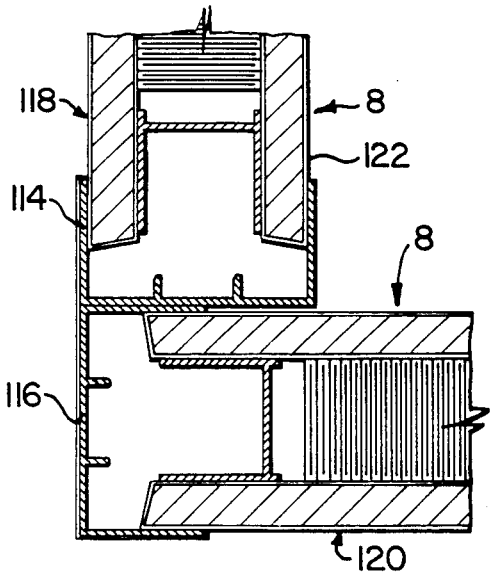
FIG. 11 is a vertical section through a 90 degree intersection according to the invention.
Figure 12:
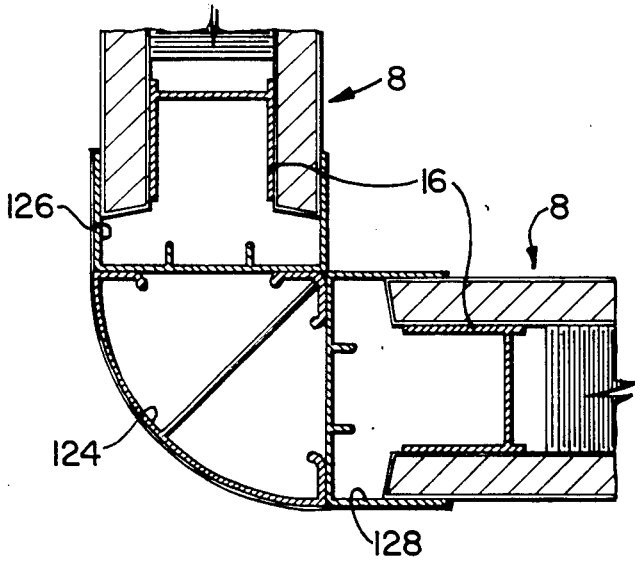
FIG. 12 is a vertical section through a rounded 90 degree intersection according to the invention.

Subsequent figures illustrate detail of additional aspects of the system. FIGS. 10, 11 and 12 show respectively a T-intersection, a squared 90 degree intersection and a round 90 degree intersection between panel assemblies. In each case there are minor variations from the basic one hundred eighty degree joint discussed above. A vertical channel 106 such as in FIG. 10 is provided to receive the end of the panel assembly 8. In order to reduce the number of different components required for a complete system, and thus reduce cost and complexity, the channel 106, and its counterparts 114, 116, 126 and 128 in FIGS. 11 and 12, may be identical to the floor channel 44. As illustrated in FIG. 10, the wall section 108 abuts wall section 110 across a joint 112, but since there is no actual connection between the two wall sections, the T-intersection could be placed as desired at any point along wall section 110. Sealing strips 111 may be interposed in the new intersection, if desired.

The 90 degree intersection illustrated in FIG. 11 is similar to the T-intersection of FIG. 10 in that a pair of end channels 114 and 116, similar to channel 106 are utilized to construct the intersection. The finished end channel 114 terminates a straight run of wall, as 118, and the 90 degree run of wall 120 is then simply added at the end. The wall 120 could equally be added at the side 122 of wall 118. This is simply a rearrangement of the same joint.

A rounded 90 degree intersection is illustrated in FIG. 12. In this case only the corner strip 124 is required in addition to the two vertical channels 126 and 128.

In FIGS. 10, 11 and 12, the exposed surfaces of the vertical channels 106, 114, 116, 126 and 128, and corner strip 124 respectively will normally be finished to match the adjacent walls.

Figure 13:
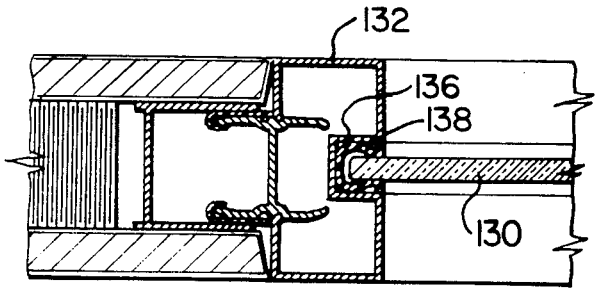
FIG. 13 illustrates a modified panel assembly incorporating a glass panel.

FIG. 13 illustrates a variation in the system in which a glass panel assembly 130 is utilized in place of the basic gypsum board one. A modified frame 132 is utilized for this purpose which mates with the spline 96 of the adjacent panel 134. The frame 132 includes a channel 136 which in turn receives therein a glazing channel 138. The glass panel 130 is held within the channel 138.

Figure 14:
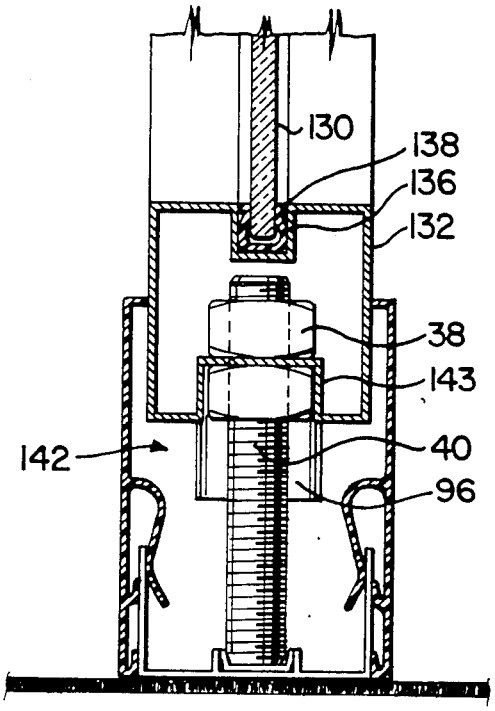
FIG. 14 illustrates the modified foot support for the glass panel.

FIG. 14 illustrates a modified adjustable panel support 142 which varies only slightly from support 22 of FIG. 2. A special channel 143 is provided in frame 132 to accommodate the nut 38. Optionally in this situation the nut 36 may be omitted and the nut 38 fixed to channel 143.

Figure 15:
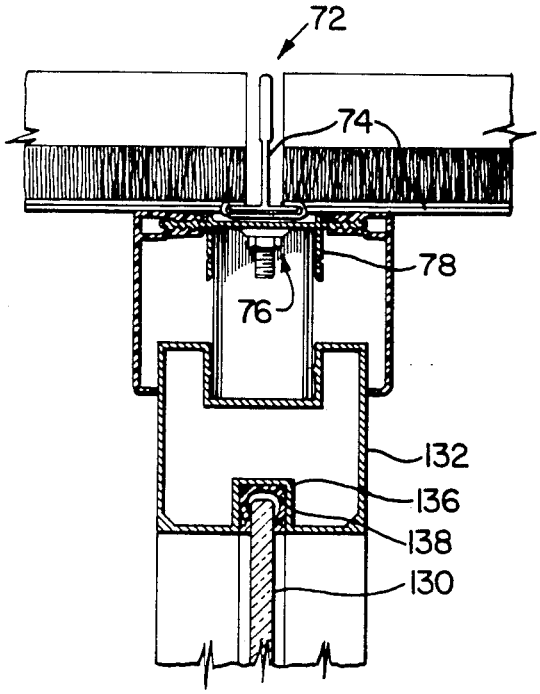
FIG. 15 illustrates the modified manner of connecting the glass panel to the ceiling.

The ceiling attachment in the case of the glass containing panels is essentially the same as that for the regular panels illustrated in FIGS. 6 and 7. FIG. 15 illustrates the manner of joining a glass panel assembly 130 to a ceiling channel 78. This is essentially the same as that illustrated in FIG. 7 for the standard panel.

Figure 16:
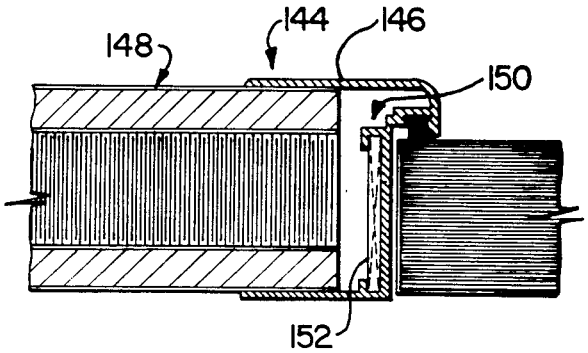
FIG. 16 illustrates one manner of incorporating a doorway into the system of the invention.

FIG. 16 illustrates one format for placing a door in the partition system. The frame 144 includes the integral channel 146 for receiving the end of panel assembly 148 and is modified to receive the door jamb structure 150. Reinforcement means 152 is included to accommodate the stress of the hinges and hanging door.

Floor and ceiling finishing strips are illustrated in FIGS. 3 and 5. Since the floor channel 44 and the ceiling channel 78 generally remain unchanged in the various configurations of the system, the finishing strips similarly serve all variations.

With reference to FIG. 3, the finishing strips 58 include the clips 154 and the supports 156 by which strips 58 can be clipped to the upstanding parts 56 of channel 44.

Similarly, referring to FIG. 5, the ceiling channel 78 includes the wing members 158 to which are clipped the finishing strips 160. The strips are relatively lightly secured by a snap fit.

All intersections, corners and the like can be accommodated by appropriate cutting of the floor and ceiling channels and finishing strips. This avoids situations common in some systems where, for example, corner channels, T-channels and the like are utilized. In those prior art situations the flexibility of the system is hampered because the panel assemblies are not independently moveable into other configurations. For example, in order to remove a 90 degree corner condition, it might be necessary to remove both panel assemblies leading to the intersection, remove the corner channel, insert the new channel, and reinstall the panel assemblies. These types of problems are avoided in the present case. Similar advantages are obtained because the finishing strips are not integral with the channels at either floor or ceiling.

Thus it is apparent that there has been provided in accordance with the invention a system for the construction of partition walls that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What we claim as our invention:

1. A non-progressive system for the construction of partition walls comprising:

(a) a floor channel adapted to be secured to a building floor;

(b) a ceiling channel adapted to be connected to a building ceiling;

(c) a series of rectangular panel assemblies each including: a rectangular frame having top, bottom and side edges, a pair of rectangular panels secured to opposite sides of said frame, and a pair of adjustable support members associated with the bottom side of the frame and in contact with the floor channel; and wherein the side edges of the frame form extensions extending beyond the top and bottom edges thereof and include longitudinal recessed channels and wherein, in use, the top of each said extension is spaced from said ceiling channel; and, (d) for installation between each pair of said panel assemblies an elongated spline extending into said ceiling channel and including first and second lateral extensions adapted to connect two adjacent panel assemblies, said spline adapted to be moved laterally from a first position in which said lateral extensions are contained entirely within the said recessed channel of one panel assembly to a second position wherein the first and second lateral extensions extend respectively into the adjacent recessed channels of said pair of adjacent panel assemblies, said spline being longer than the length of the frame side edge member.

2. The system of claim 1 wherein the length of the side edges is chosen so that in use that length, including the said extensions, is less than the distance between the floor and ceiling channels.

3. The system of claim 1 wherein the adjacent edges of the said panels of a pair of panel assemblies abut against each other in use.

4. A system for the construction of partition walls comprising:

(a) a floor channel adapted to be secured to a building floor;

(b) a ceiling channel adapted to be connected to a building ceiling;

(c) a series of rectangular panel assemblies each including: a rectangular frame having top, bottom and side edges, a pair of rectangular panels secured to opposite sides of said frame, and a pair of adjustable support members associated with the bottom side of the frame; and wherein the side edges of the frame extend beyond the top and bottom edges thereof and include longitudinal recessed channels; and (d) an elongated spline including first and second lateral extensions adapted to connect two adjacent panel assemblies and to extend into said ceiling channel, said spline adapted to be moved laterally from a first position wherein the spline is contained entirely within the said recessed channel of one panel assembly to a second position wherein the first and second lateral extensions extend respectively into the adjacent recessed channels of said pair of adjacent panel assemblies;

wherein the length of the side edges is chosen so that in use that length, including the said extensions, is less than the distance between the floor and ceiling channels; and wherein the bottom of said spline when in use is lower than the end of the bottom end of the frame extension.

5. A system for the construction of partition walls comprising:

(a) a floor channel adapted to be secured to a building floor;

(b) a ceiling channel adapted to be connected to a building ceiling;

(c) a series of rectangular panel assemblies each including: a rectangular frame having top, bottom and side edges, a pair of rectangular panels secured to opposite sides of said frame, and a pair of adjustable support members associated with the bottom side of the frame; and wherein the side edges of the frame extend beyond the top and bottom edges thereof and include longitudinal recessed channels; and (d) an elongated spline including first and second lateral extensions adapted to connect two adjacent panel assemblies and to extend into said ceiling channel, said spline adapted to be moved laterally from a first position wherein the spline is contained entirely within the said recessed channel of one panel assembly to a second position wherein the first and second lateral extensions extend respectively into the adjacent recessed channels of said pair of adjacent panel assemblies;

wherein the length of the side edges is chosen so that in use that length, including the said extensions, is less than the distance between the floor and ceiling channels; wherein the bottom of said spline when in use is lower than the end of the bottom end of the frame extension; and wherein the lateral extensions of the spline are adapted to be secured to the respective frame extensions of the side edges of adjacent panel assemblies.

* * * * *